US008348072B2

(12) United States Patent
Whitehall et al.

(10) Patent No.: US 8,348,072 B2
(45) Date of Patent: Jan. 8, 2013

(54) TENSION-MOUNTED POLE CADDY

(75) Inventors: Richard Whitehall, New York, NY (US); Jonathan Cedar, Brooklyn, NY (US); Alec Drummond, Austin, TX (US)

(73) Assignee: Helen of Troy Limited, Belleville, St. Michael (BB)

( * ) Notice: Subject to any disclaimer, the term of this patent is extended or adjusted under 35 U.S.C. 154(b) by 749 days.

(21) Appl. No.: 12/383,137

(22) Filed: Mar. 20, 2009

(65) Prior Publication Data

US 2010/0237032 A1 Sep. 23, 2010

(51) Int. Cl.
*A47B 47/00* (2006.01)

(52) U.S. Cl. ..... 211/196; 211/90.02; 211/107; 248/408

(58) Field of Classification Search ..... 211/103, 211/153, 175, 187, 90.02, 196, 107, 205; 248/351, 354.1, 408, 200.1; 108/146, 136
See application file for complete search history.

(56) References Cited

U.S. PATENT DOCUMENTS

| | | | | | |
|---|---|---|---|---|---|
| 1,048,143 | A | | 12/1912 | Franke | |
| 1,581,463 | A | | 4/1926 | Moors | |
| 1,867,763 | A | * | 7/1932 | Rose | 108/8 |
| 2,016,132 | A | * | 10/1935 | Bergslien | 248/409 |
| 2,481,604 | A | * | 9/1949 | Lorenzen | 108/152 |
| 2,907,598 | A | * | 10/1959 | Hart | 403/112 |
| 2,974,931 | A | | 3/1961 | Reel et al. | |
| 3,409,230 | A | | 11/1968 | Eelkema | |
| 3,712,574 | A | | 1/1973 | Rothermel | |
| 3,807,574 | A | | 4/1974 | Lanza | |
| 3,854,428 | A | * | 12/1974 | Fullenkamp | 108/146 |
| 4,311,101 | A | * | 1/1982 | de Almagro | 108/152 |
| 4,343,578 | A | | 8/1982 | Barnes | |
| 4,601,246 | A | | 7/1986 | Damico | |
| 4,821,988 | A | | 4/1989 | Jimenez | |
| 4,878,642 | A | | 11/1989 | Kirby, Jr. | |
| 5,016,846 | A | | 5/1991 | Solomon | |
| 5,186,429 | A | | 2/1993 | Linnepe et al. | |
| 5,482,237 | A | | 1/1996 | Wang | |
| 5,558,501 | A | * | 9/1996 | Wang et al. | 416/244 R |
| 6,042,066 | A | | 3/2000 | Maharg et al. | |
| 6,152,434 | A | * | 11/2000 | Gluck | 269/6 |
| 6,213,434 | B1 | | 4/2001 | Reichanadter, Jr. | |

(Continued)

OTHER PUBLICATIONS

International Search Report and Written Opinion dated Jan. 13, 2010 re PCT/US2009/061646.

*Primary Examiner* — Korie Chan

(57) ABSTRACT

A tension-mounted pole caddy for mounting between two substantially parallel surfaces is disclosed. The pole device generally includes a first tubular body, a second tubular body, a toothed rack, a locking pawl, and a base-mounted lever for operation of the locking pawl. Preferably, the first tubular body includes a base end for contacting a surface and a telescoping end, while the second tubular body has a base end for contacting a second surface and a telescoping end coupled with the telescoping end of the first body. The toothed rack is affixed within the first body portion proximate the telescoping end, with the locking pawl within the second body and capable of movement to engage and disengage the toothed rack. The lever is coupled to the locking pawl via linkage, such that operation of the lever between a first and second position actuates the locking pawl to engage and disengage, respectively, from the toothed rack, wherein the lever is positioned at the base end of the second tubular body.

10 Claims, 10 Drawing Sheets

U.S. PATENT DOCUMENTS 6,286,795 B1 9/2001 Johnson
6,390,746 B1 5/2002 Huang
6,409,131 B1 6/2002 Bentley et al.
6,594,910 B2 7/2003 Wishart
6,688,238 B1 * 2/2004 Alexiou ..... 108/42
6,804,893 B2 * 10/2004 Watson et al. ..... 33/290
6,820,842 B1 11/2004 Chuang
6,851,652 B1 2/2005 Huang
6,854,402 B2 2/2005 DuBarry et al.
6,971,290 B1 * 12/2005 Ybarra ..... 81/177.2
7,111,812 B2 9/2006 Shannon et al.
7,178,767 B2 2/2007 Steyn et al.
7,290,742 B2 11/2007 Wang
7,331,567 B2 2/2008 Li
D569,148 S * 5/2008 Yang et al. ..... D6/525
2007/0215781 A1 9/2007 Watt et al.
2007/0252061 A1 11/2007 Feetham et al.
2008/0035592 A1 2/2008 Yang et al.
2008/0098861 A1 5/2008 Engvall et al.
2008/0157546 A1 7/2008 Vitry et al.

* cited by examiner

TENSION-MOUNTED POLE CADDY

TECHNICAL FIELD OF THE INVENTION

The present device relates to a surface-to-surface pole for supporting shelving units. Particularly, the present device relates to a tension-mounted pole which vertically spans a space while supporting shelving units, such as for use in a shower area or the like.

BACKGROUND OF THE INVENTION

Tension poles have existed for some time. Generally speaking, they provide a mechanism for supporting other devices. Used vertically, they can support, for example, lighting fixtures, shelving units, and the like, while horizontal poles are used for garment display, garment storage, window coverings, and the like. Tension poles are effective as a temporary or even semi-permanent means of support and can be erected and secured in a minimum of time with little mechanical ability. Tension poles are versatile because they can be located nearly anywhere, extend vertically, and span the distance between two surfaces, like a floor and ceiling. It is the tension of the device, exerted between the surfaces, which provides the stability to maintain the pole in position.

Most basically, a typical tension pole is comprised of a first pole having a bottom foot to contact and grip a first lower surface with a smaller diameter second pole telescopically housed in and extending from the first pole, the second pole also having a foot which is intended to contact a second upper surface. The two poles are usually spring-biased outward relative to one another. One problem with such a design is that the device is either adjustable over a small span and/or the expansion force of the poles can be damaging to the support surfaces.

In operation, the rubber foot on the lower pole of the spring-biased prior art device is placed on a desired lower surface (e.g., a floor). The user then pushes on the upper/second pole, against the force of the spring, to temporarily collapse and telescope the second pole into the first. With the second pole so held, the device is tilted into as near to a vertical orientation as possible. The second pole is then carefully released to allow the internal spring of the device to cause expansion until the rubber foot of the second pole contacts the upper surface (e.g., a ceiling). If the pole is askew, then the user can, again, push the rod into the pole, against the outward bias of the spring, in an effort to align the pole into a proper vertical orientation.

As the telescoping second pole may be positioned above the middle of the pole device at a considerable height, short users may encounter considerable difficulty in attempting to orient the spring-biased device. Also, its strength of being held in a vertical position is directly dependent on the strength of the contained spring. Yet, the stronger the spring, which will hold the pole in place, the more difficult the installation since to perform the installation the spring is first manually compressed until selectively released.

Accordingly, another problem with the spring-biased design is that the installation is not always easy since the user must try to compress the two poles, against the strong outward bias of the spring, and, at the same time, try to place the pole into a vertical orientation. It should be readily apparent that the tension pole of the prior art, of the telescopic pole, rod and spring type, is sometimes difficult to operate.

The present tension-mounted pole caddy solves these and other issues of the prior art by providing a design which is adjustable between a large range of surface spans and is easily placed and removed with little difficulty. The disclosed device avoids the disadvantages of prior devices while affording additional structural and operating advantages.

SUMMARY OF THE INVENTION

In accordance with the present invention, there is disclosed herein an improved tension-mounted pole for mounting between two substantially parallel surfaces, the pole device generally comprising a first tubular body, a second tubular body, a toothed rack, a locking pawl, and a base-mounted lever for operation of the locking pawl.

In a preferred embodiment, the first tubular body includes a base end for contacting a surface and a telescoping end, while the second tubular body has a base end for contacting a second surface and a telescoping end coupled with the telescoping end of the first body. The toothed rack is affixed within the first body portion proximate the telescoping end, with the locking pawl within the second body and capable of movement to engage and disengage the toothed rack. The lever is coupled to the locking pawl via linkage, such that operation of the lever between a first and second position actuates the locking pawl to engage and disengage, respectively, from the toothed rack, wherein the lever is positioned at the base end of the second tubular body.

In a preferred embodiment, the lever is pivotably mounted within and forms a part thereof the base end of the second tubular body. Preferably, the lever is substantially flush with a surface of the base end when in the first position.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF PREFERRED EMBODIMENTS

Figure 1:
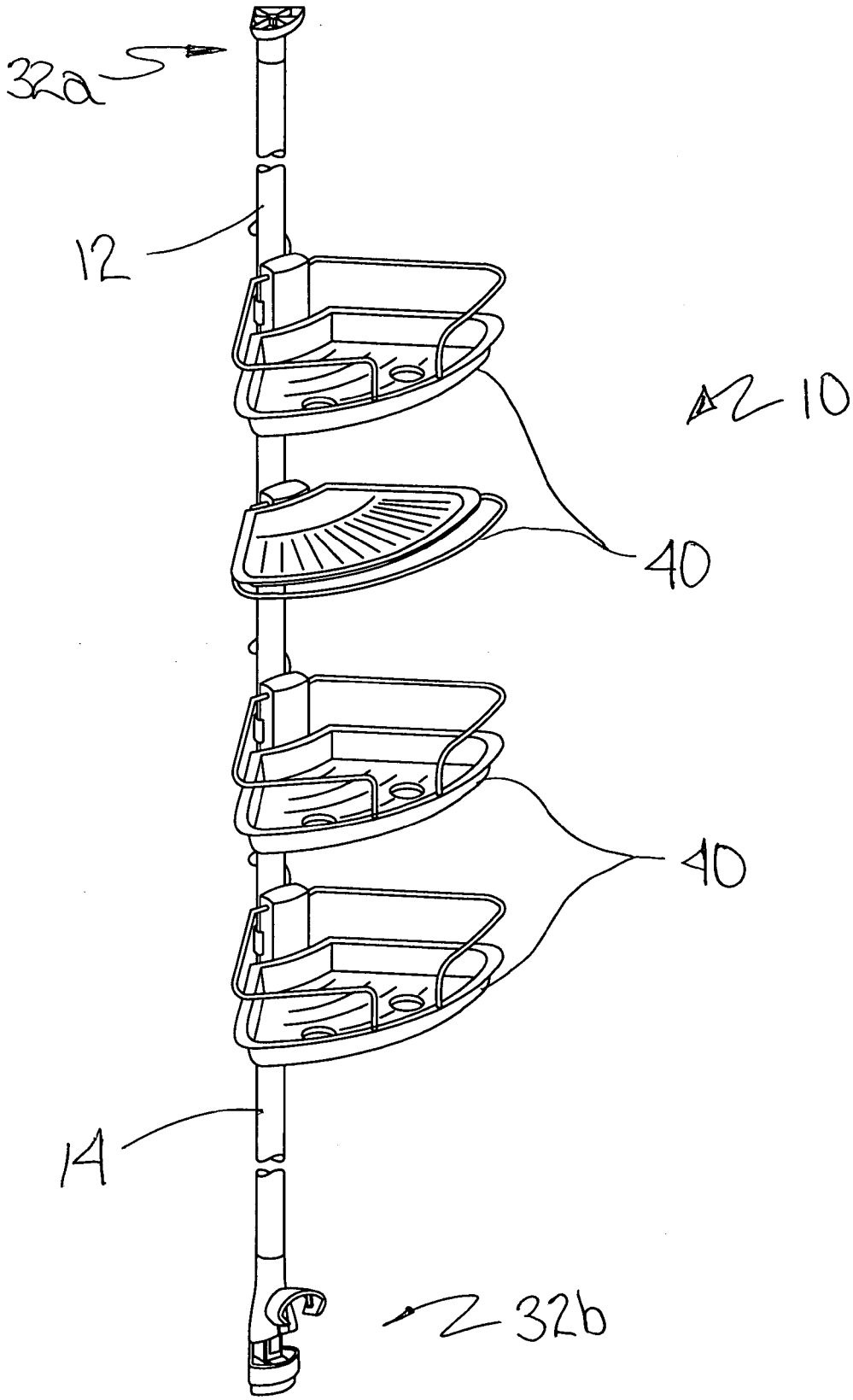
FIG. 1 is a perspective view of an embodiment of the present tension pole caddy device.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

Figure 2:
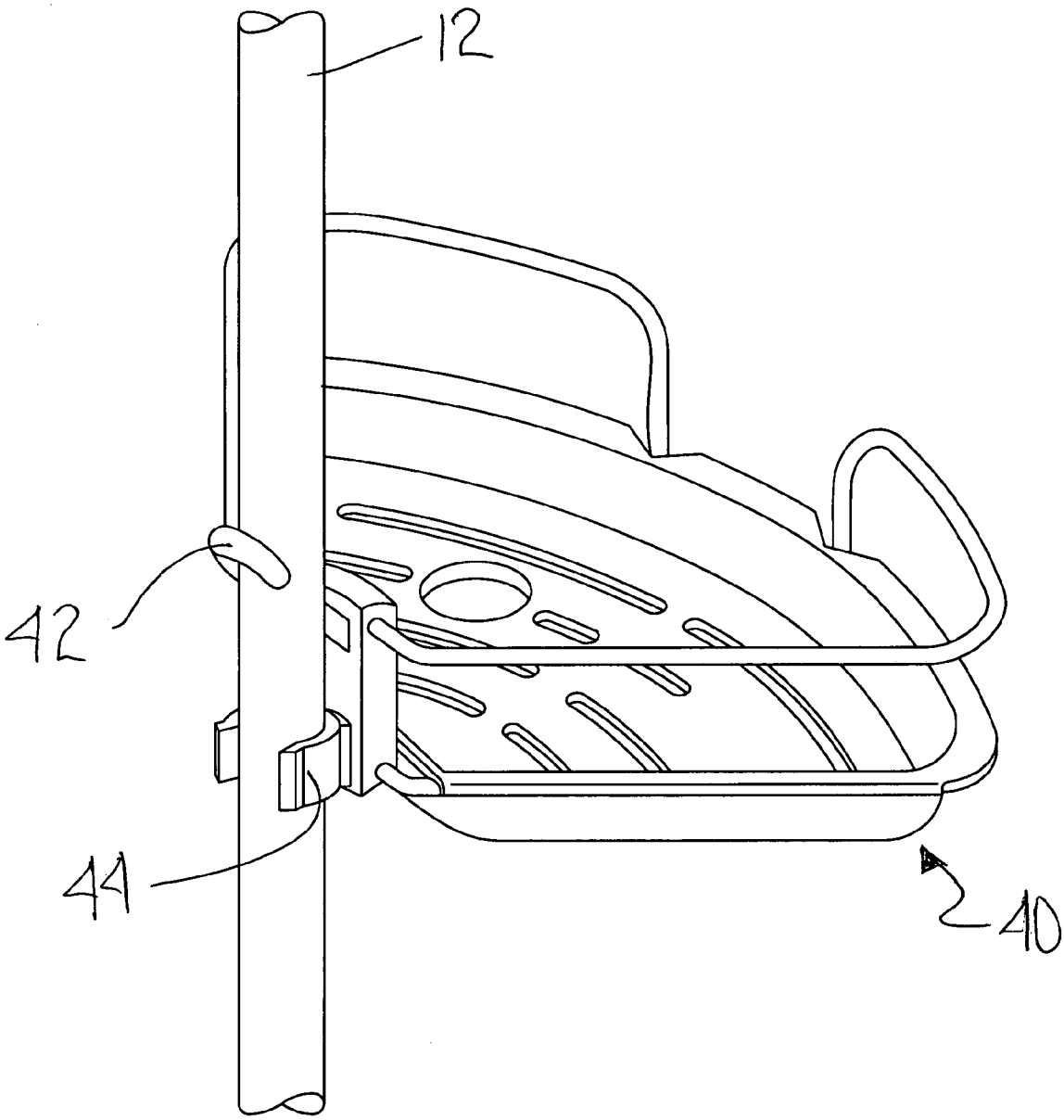
FIG. 2 is a rear perspective view of an embodiment of a shelf attached to the pole caddy.
Figure 3:
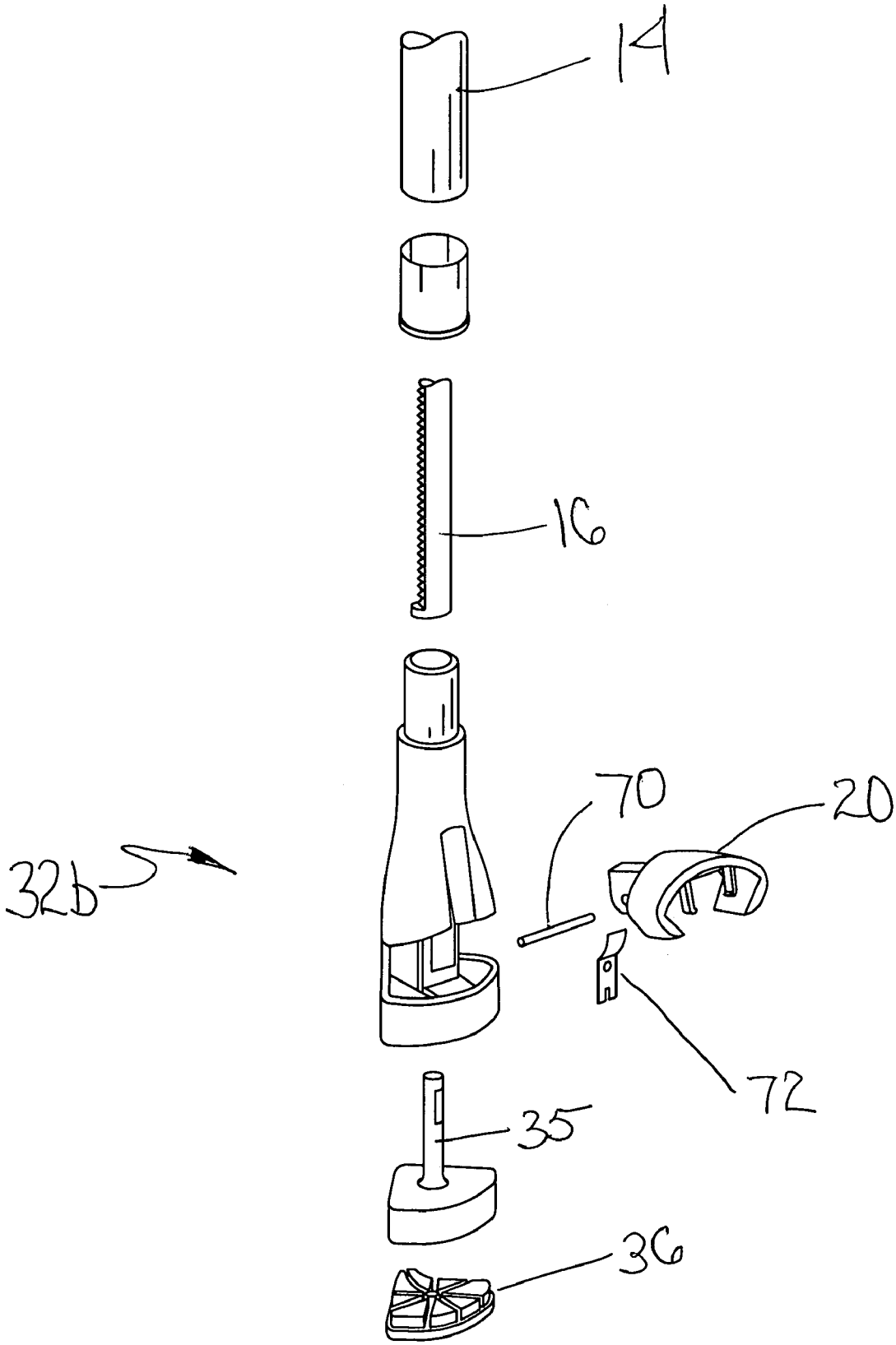
FIG. 3 is an exploded view of a base end of the second (lower) tubular body of the described pole caddy.
Figure 4:
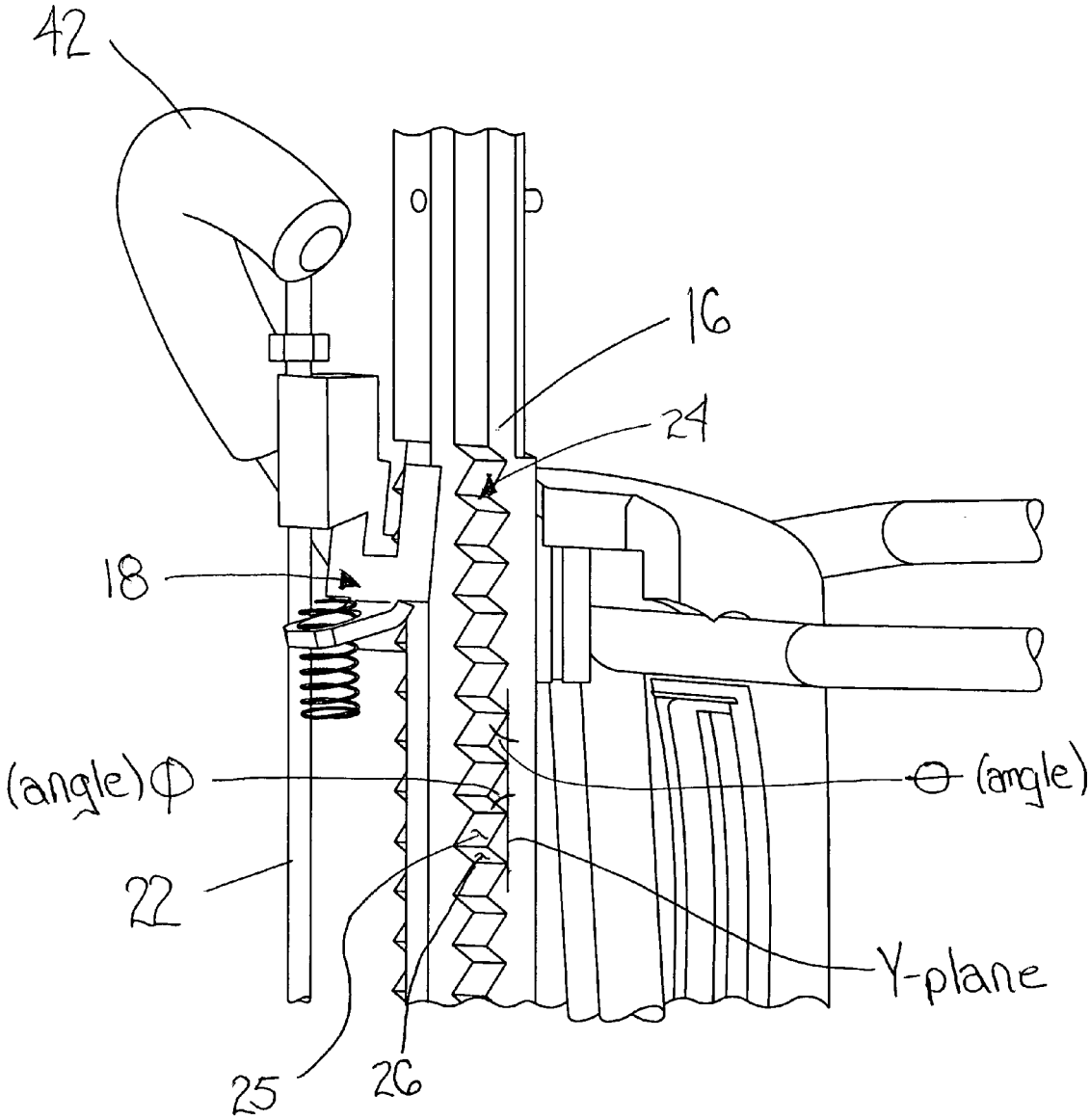
FIG. 4 is a close up cut-away showing an embodiment of the internal mechanism of the pole caddy.
Figure 5:
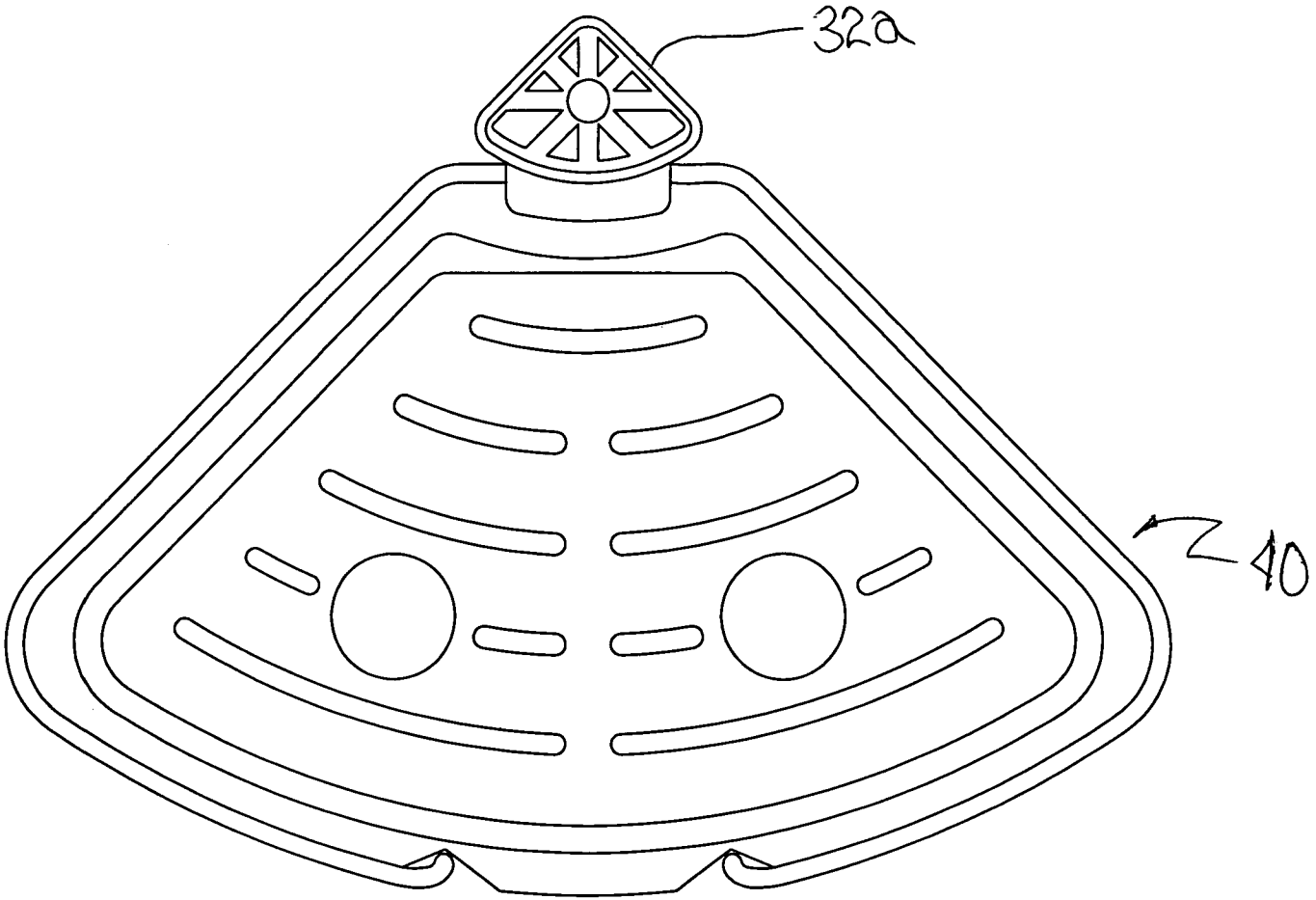
FIG. 5 is a top view of an embodiment of the pole caddy.
Figure 6:
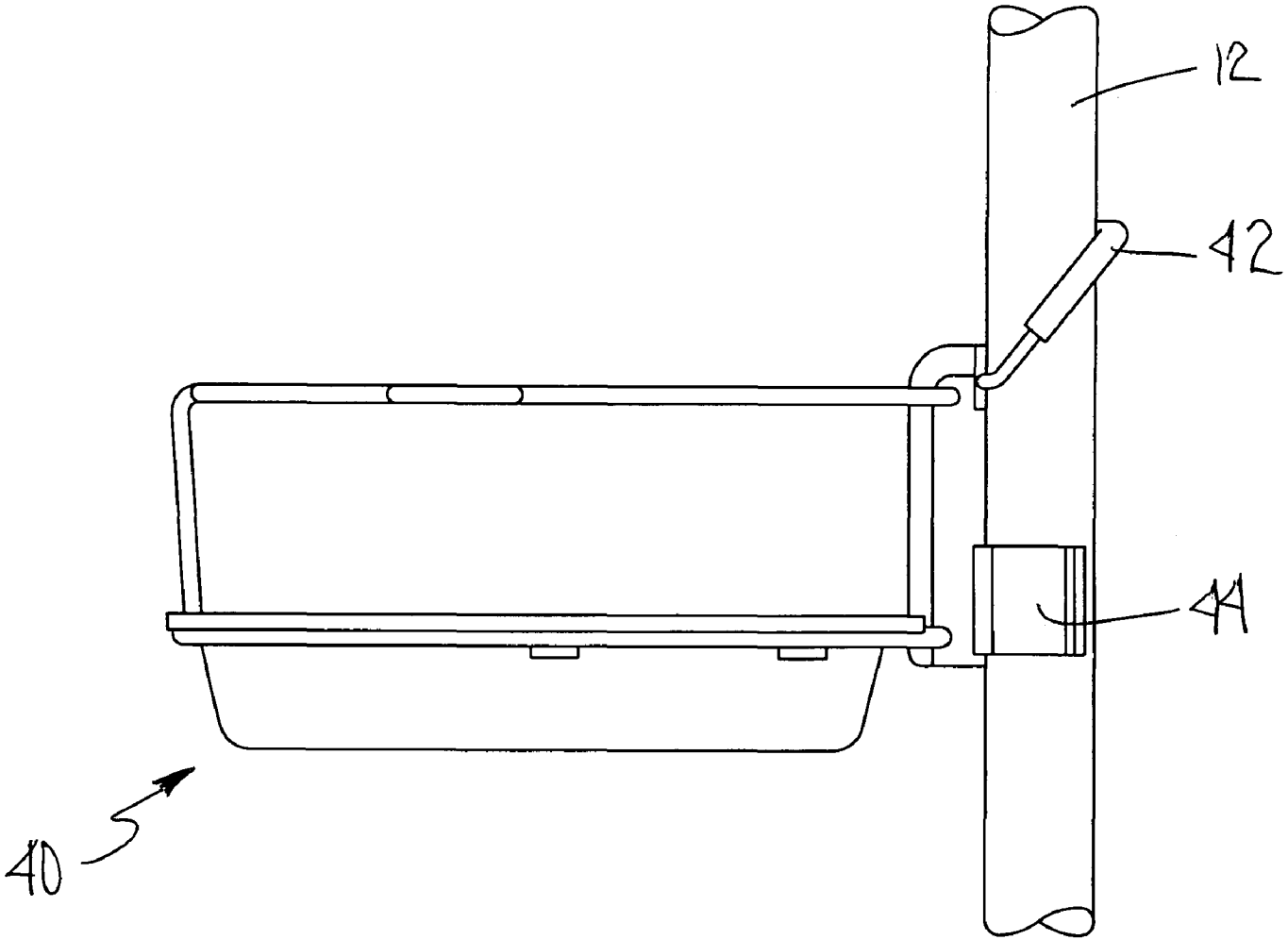
FIG. 6 is a side view of one embodiment of a shelf attached to the pole caddy.
Figure 7:
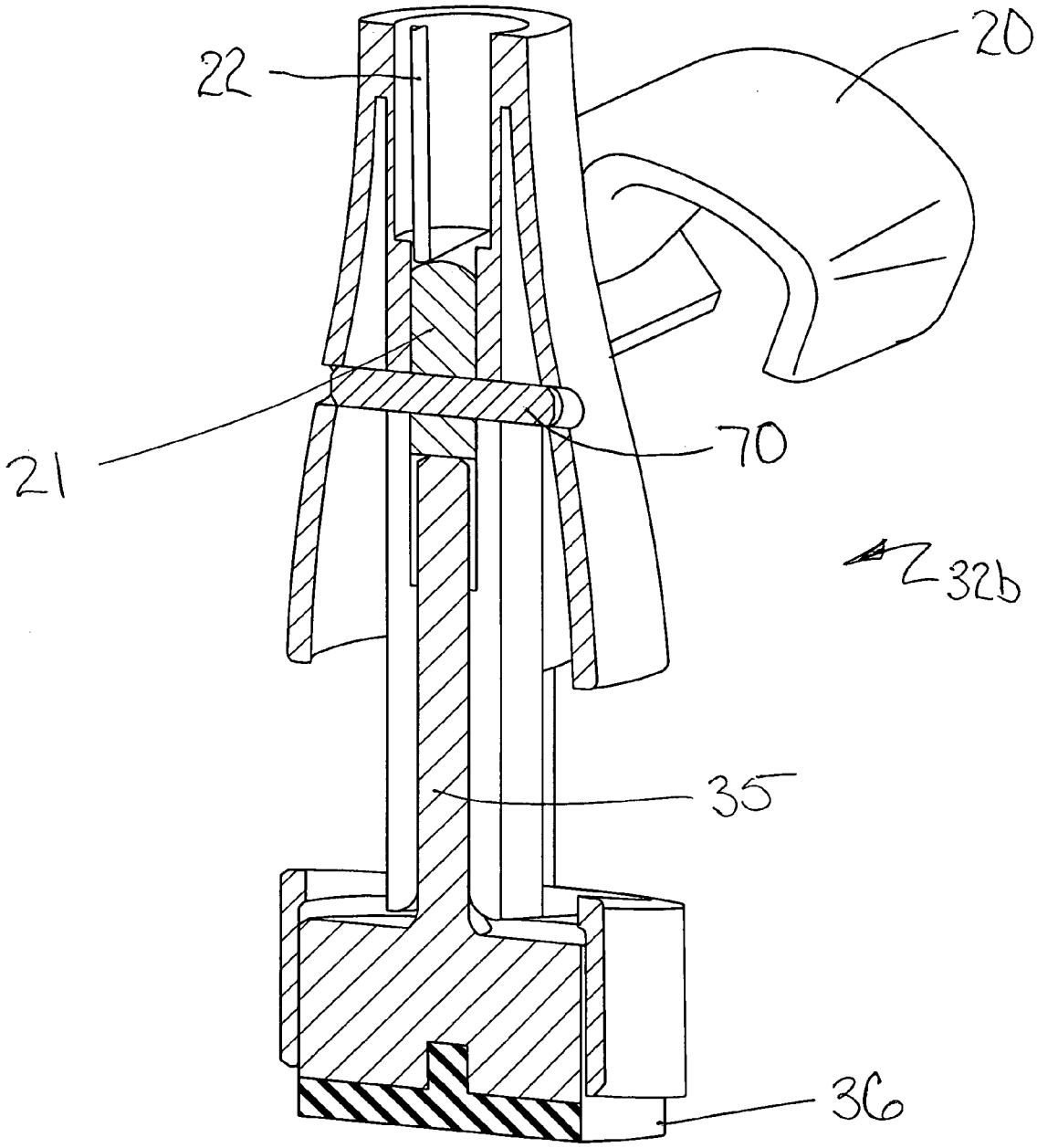
FIG. 7 is a cross-section of a base end of the pole caddy.
Figure 8:
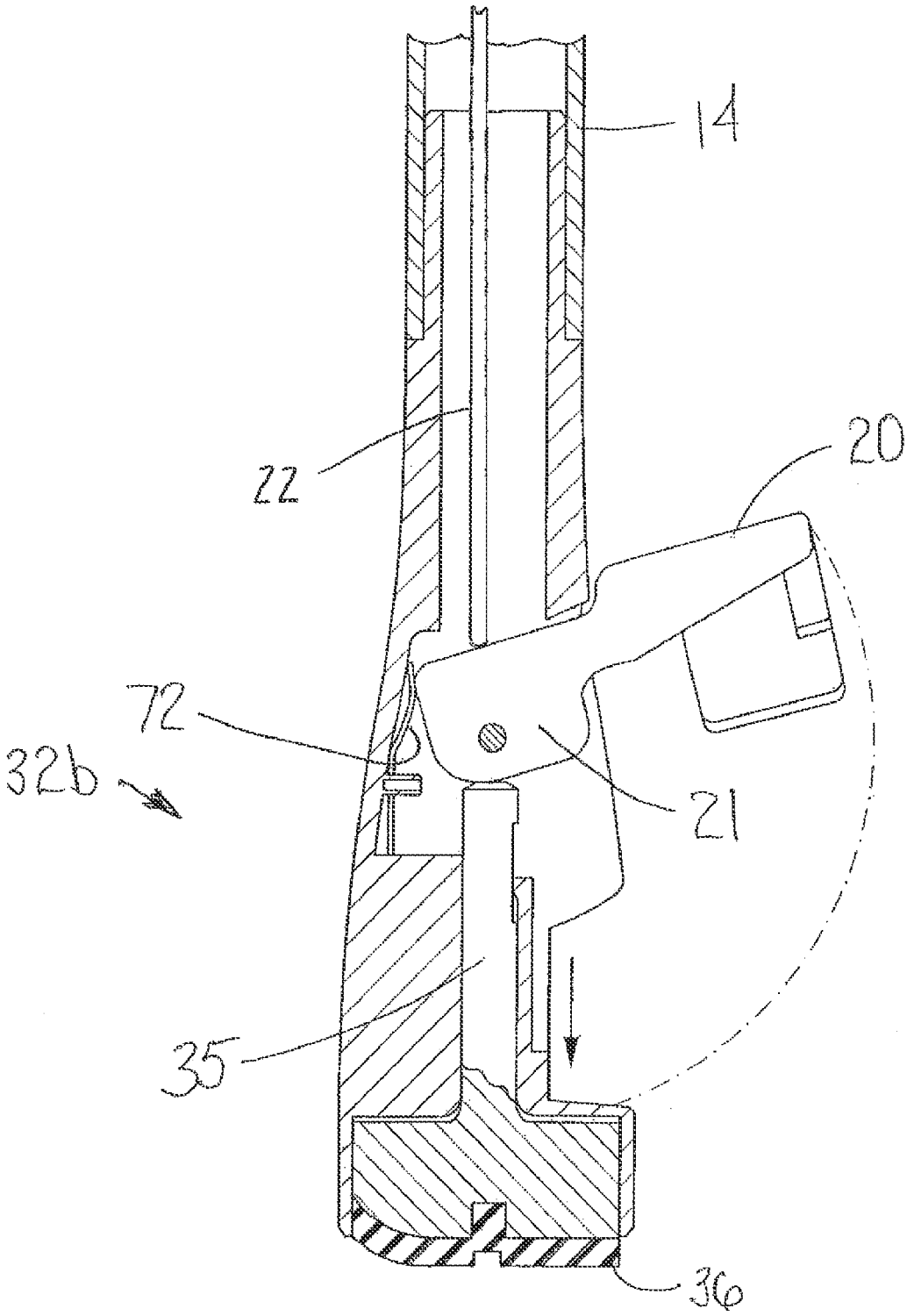
FIG. 8 is a side, cross-section of a base end illustrating the operation of the lever.
Figure 9:
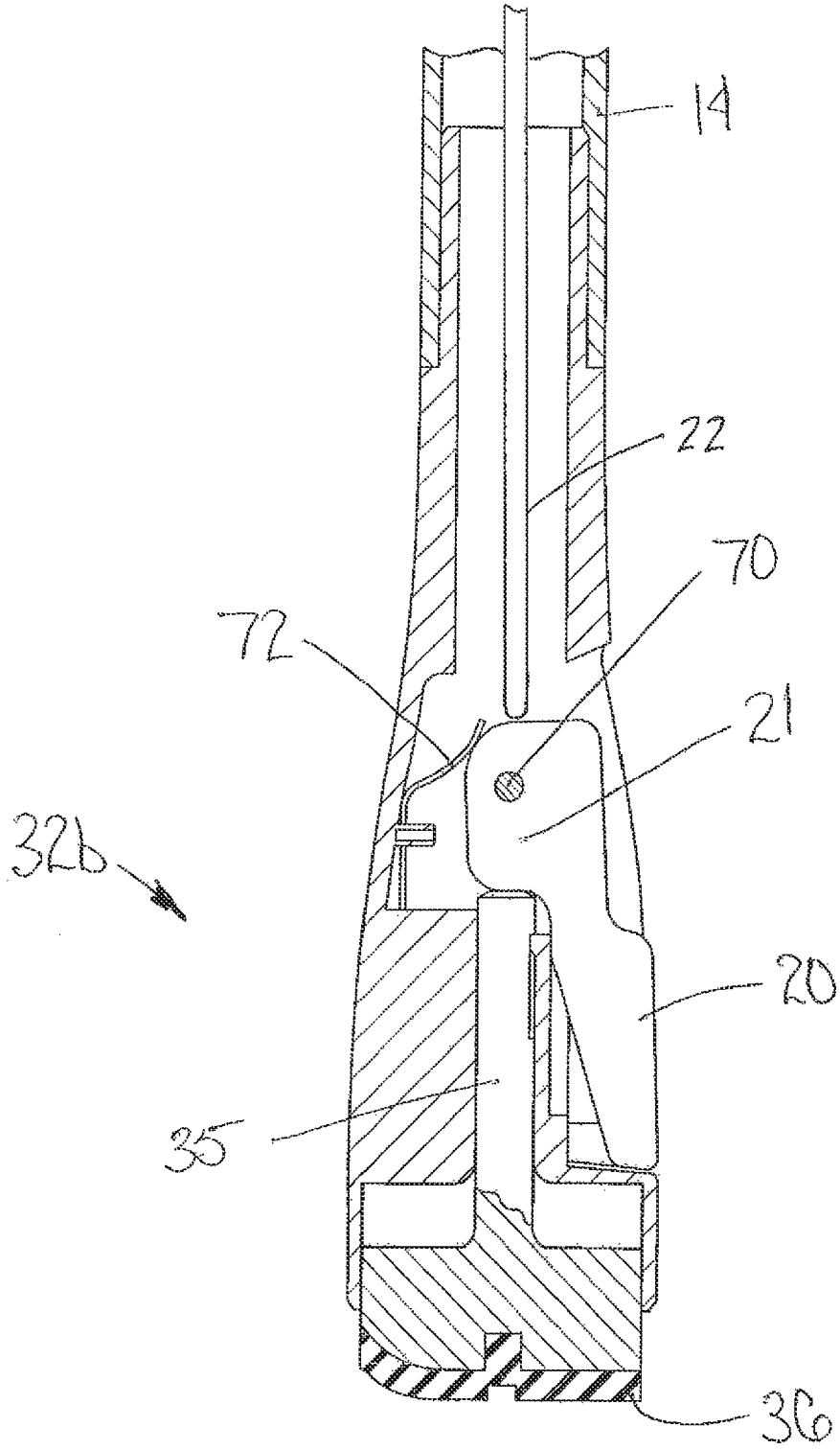
FIG. 9 is also a side, cross-section of the base end of FIG. 8, illustrating operation of the lever.
Figure 10:
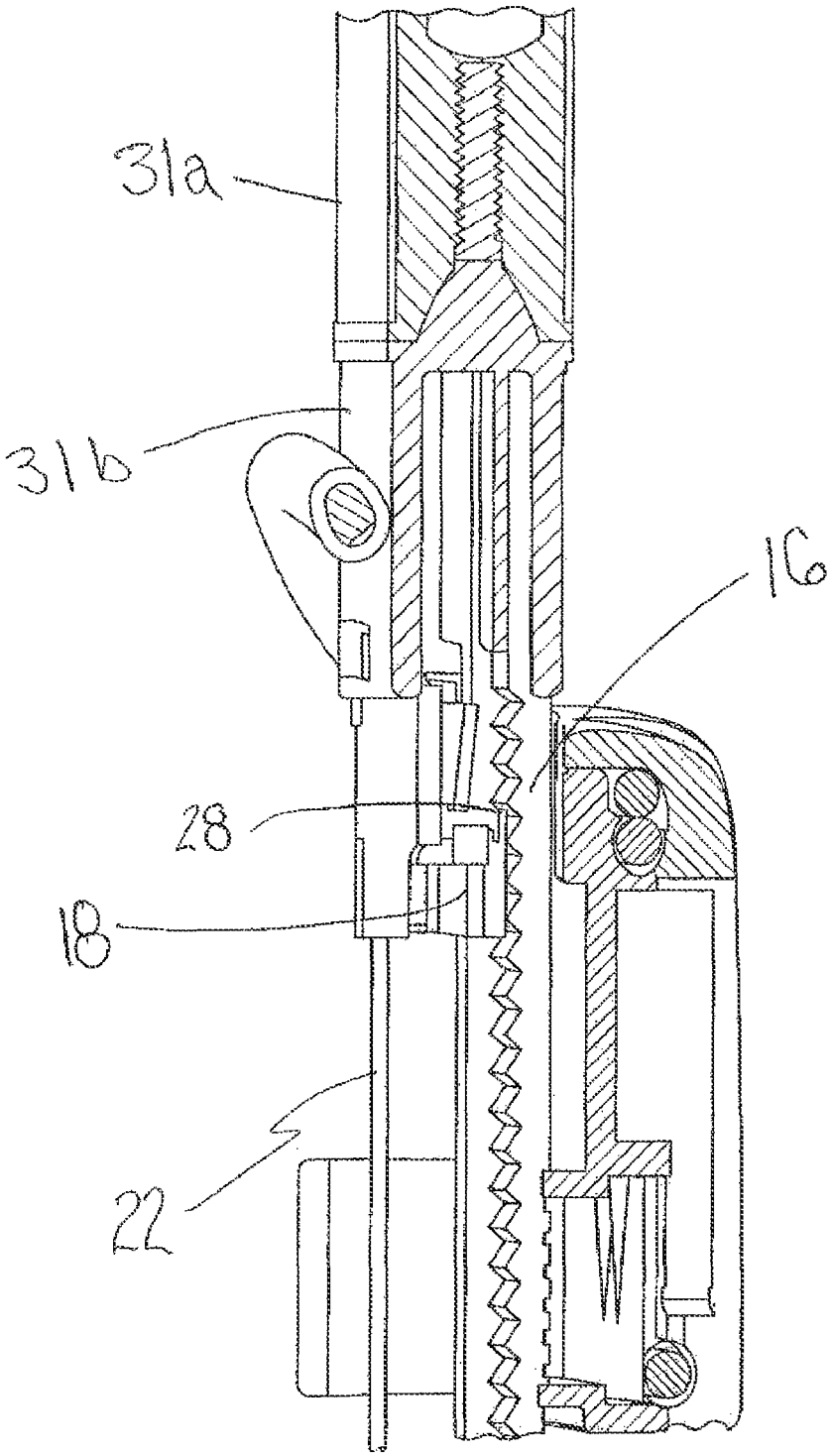
FIG. 10 is a cut-away illustrating an embodiment of the pawl and rack mechanism of the pole caddy.

Referring to FIGS. 1-10 throughout the following detailed description, there is illustrated a tension-mounted pole caddy, generally designated by the numeral 10. The caddy 10 is typically used as a decorative support for shelves, clothing, window dressings and such by mounting between two substantially parallel surfaces using an outward tension at two surface contacting ends. The surfaces may be oriented either horizontally, requiring a vertical support as, for example, in a bathroom shower stall, or vertically, requiring a horizontal support as, for example, in a closet or window box. The two surfaces need not be exactly parallel, so long as a properly mounted pole is able to maintain its position when spanned between the two surfaces.

Generally speaking, the caddy 10 is comprised of a first tubular body 12, a second tubular body 14 telescoping with the first tubular body 12, a toothed rack 16, a locking pawl 18, and a lever 20. Referring to the several drawing figures, the preferred assembly of the components can be more readily understood.

The first and second tubular bodies 12, 14, each have a telescoping end 31(*a* and *b*, respectively) and a base end 32(*a* and *b*, respectively) for contacting one of the two surfaces (not shown). Each base end 32*a-b* includes a properly padded bottom area 36 for contacting a surface without marring that surface in any way. Material such as rubber or a thermoplastic elastomer may be adhered to the bottom area 36 to provide the necessary grip and cushioning at the contact point. The base end 32 may also include a cover (not shown) to decoratively hide the pole end at the surface. Such a cover may be a molded plastic shell fixed to the pole end, or any other similar component permanently or detachable connected to the pole end for decorative purposes. The base ends 32*a-b* of each of the two tubular bodies 12, 14 are not necessarily identical, as will become more apparent below.

As mentioned, the two tubular bodies 12, 14 are telescoped together to allow variation of the length/height of the caddy 10. Preferably, the first (upper) tubular body 12 has a diameter less than that of the second (lower) tubular body 14 so that the first body 12 slidably fits within the second body 14. The two tubular bodies 12, 14 are approximately the same length, giving the caddy 10 the ability to almost double in length from a fully compacted position to a fully extended position. Naturally, the tubular bodies 12, 14 can be of different lengths for some applications.

Within the tubular bodies 12, 14 the mechanism for adjusting and locking the span of the caddy 10 may be found. The adjustment mechanism is comprised of a toothed rack 16, a locking pawl 18, and a lever 20 which connects to the pawl via linkage 22. The toothed rack 16 is shown in the appended drawings to be positioned within the first (upper) tubular body 12 with the teeth 24 accessible from the interior. The toothed rack 16 is of molded plastic and includes two identical lengths of teeth 24 which run parallel to one another. As shown, the teeth 24 are cut in a manner such that the outward face 25 of the tooth forms an angle (θ) with respect to the base plane (Y) which is less than the angle (ϕ) formed between the bottom face 26 of the tooth and the base plane (Y). In fact, the bottom face 26 is nearly perpendicular to the base plane (Y) to form a "catch point" as explained below. The rack 16 preferably runs a substantial length of the first tubular body 12 to optimize the expansion capability of the caddy 10. The end of the rack 16 may include a "stop" to limit expansion beyond rack 16, if desired.

The locking pawl 18 may be attached in any suitable manner within the second (lower) tubular body 14. The locking pawl 18 is a biasing, pivoting-mechanism having a protrusion 28 configured to engage the rack 16, specifically the teeth 24 of the rack 16. The preferred locking pawl 18 includes two protrusions which align with the two lengths of teeth 24 on the rack 16. The pawl 18 may be locked outward, as explained below, to force the protrusions 28 into engagement with the rack 16 at a "catch point" between two teeth. In this locked outward arrangement, the rack 16, and therefore the first tubular body 12, is prevented from traveling in a compression (downward as shown) direction by the pawl 18. However, the rack 16, and therefore the first tubular body 12, is still capable of traveling in an expansion direction, as the pawl 18 is capable of pivoting responsive to the outward face 25 of the tooth. When the pawl 18 is moved to a retracted position it is prevented from engaging the rack 16. Accordingly, the tubular bodies 12, 14 are free to be expanded and contracted while the pawl 18 is retracted.

The lever 20 is a pivoting mechanism which operates to move the locking pawl 18 between an engaged (i.e., locked outward) and disengaged (i.e., retracted) position. The free end of the lever 20 is movable, while the hinged end, held in place by pin 70, includes a cam feature 21 or other suitable and similar mechanism to which the linkage 22 may attach. The linkage 22 connects the locking pawl 18 to the lever 20, as shown. When the lever 20 is moved outward, the linkage 22 responds by moving the pawl 18 into a retracted position where it cannot engage the rack 16. Conversely, when the lever 20 is pivoted to a closed position, the linkage 22 moves the pawl 18, and thereby the protrusions 28, into engagement with the teeth 24 of the rack 16. When the protrusions 28 sit at a "catch point" the tubular bodies 12, 14 are locked against further compression.

Preferably, a biasing member 72 assists in biasing the lever 20 toward the closed position by imparting a small force on the cam feature 21. The force is reduced or terminated as the lever 20 is locked in the closed position.

Additionally, the padded bottom area 36 of the end 32*b* is actuated outward by the closing of lever 20. The padded bottom area 36 comprises a rod 35 which travels coaxial with the second tubular body 14 within the base end 32*b*. The cam feature 21 of the hinged lever 20 engages the rod 35 such that as the lever 20 moves from an open position to a closed position, the cam feature 21 forces the rod 35, and thereby the padded bottom area 36, outward from the base end 32*b*. The travel distance is dependent upon the length of the cam feature 21 on the hinged lever 20. This mechanism provides fine tensioning on the pole caddy 10 necessary as a result of the spacing between teeth 24 of the rack 16.

In alternative embodiments of the locking mechanism (e.g., pawl 18), not shown but certain to be understandable to those of skill in the art, the lever 20 is still used to actuate the locking and unlocking feature. Other suitable mechanisms certainly exist for locking the tubular bodies 12, 14 at any desired length. For example, instead of a locking pawl, a spur gear might be used with the toothed rack 16. Rotation of the spur gear could alter the expansion of the caddy and the lever 20 in base end 32*b* would be used to lock (or disengage) such a gear, thereby locking the tubular bodies 12, 14 in place (relative to one another) as well.

Still another possibility involves the use of a thermoplastic rubber (TPR) or some other high-friction material which would suitably bind against, for example, the interior of at least one of the tubular bodies. For example, the movement of the lever 20 may, via linkage, force a component coated with the high-friction material to press against an inside wall and thereby bind the tubular bodies 12, 14. This embodiment may be suitable for certain applications.

The base end 32*b* of the second (lower) tubular body 14 can be more readily understood from review of the appended drawing figures. The base end 32*b* may either be a unitary (i.e., single) piece with the second tubular body 14, or it may be a separate component permanently or detachably affixed to the second body 14. In the featured embodiment, the base end 32*b* is a flared component having the lever 20 hinged thereto. The lever 20 is preferably configured to conform to the shape and contour of the flared base end 32*b* for aesthetic purposes.

Accessories, such as shelving 40 may be optionally attached along the length of the caddy 10. The preferred embodiment of the present caddy 10 is for use in a shower stall or the like to provide support space for items such as shampoos and conditioners, razors, soap, brushes and any other desired product. Accordingly, the featured shelves are specifically configured with hooks, slots, rails, and the like, to hold such products, as well as perforated bases to facilitate drainage of water (and other liquids). The illustrated shelving 40 include a unique attachment mechanism.

The attachment mechanism comprises a hook 42 which wraps about the caddy body 12, 14 holding the shelf 40 in a pitched manner. The mechanism further comprises a clamp 44 which clips to the caddy body 12, 14 to bring the shelf 40 into a substantially horizontal state. The hook 42 and clamp 44 are preferably of a molded plastic or coated to avoid marring the caddy body 12, 14.

In use, the present caddy 10 is very easy to set up and remove. To set up, the base end 32*b* of the second (lower) tubular body 14 is positioned on lower surface (not shown). With the lever 20 in the closed position, the first (upper) tubular body 12 should be extended until it contacts an upper horizontal surface (not shown). Due to the padded contacts, the caddy 10 may be locked at a length which applies sufficient pressure to the surfaces without defacing the surfaces. Once a proper vertical pole is established, the accessory shelves 40 may be added, as desired.

To remove, or merely move, the caddy 10 from a seated position between two substantially parallel surfaces, the lever 20 can be pivoted to the open position to disengage the locking pawl 18 from the rack 16, as described above. The first (upper) tubular body 12 can then be lowered to break contact with the upper of the two parallel surface (not shown). The caddy 10 may then be repositioned following the steps set forth above.

The matter set forth in the foregoing description and the several accompanying drawing figures is offered by way of illustration only and not as a limitation to the scope of the disclosed device. While particular embodiments and features have been shown and described, it will be apparent to those skilled in the art that changes and modifications may be made to such embodiments and features without departing from the broader aspects of applicants' contribution. The actual scope of the protection sought is intended to be defined in the following claims when viewed in their proper perspective based on the prior art.

What is claimed is:

1. A tensioning pole for mounting between two substantially parallel surfaces, the pole comprising:

a first tubular body having a telescoping end and a free end;

a second tubular body having a telescoping end coupled with the telescoping end of the first body and a free end;

a first surface contact base connected to the free end of the first tubular body;

a second surface contact base connected to the free end of the second tubular body;

a toothed rack affixed within the first body proximate the telescoping end of the first body;

a locking pawl within the second body proximate the telescoping end of the second body, the locking pawl capable of movement between engagement and disengagement with the toothed rack; and a lever coupled to the locking pawl via a linkage, such that operation of the lever between a first retracted position and second outward position actuates the locking pawl to move between engagement and disengagement with the toothed rack, respectively, wherein the lever is positioned on the second surface contact base and the second surface contact base includes a cutout dimensioned to receive the lever in the first position, wherein the lever includes an engagement portion and the second surface contact base includes a moveable base portion, wherein as the lever is moved toward the first position the engagement portion contacts the base portion and displaces the base portion in a direction opposite the telescoping end of the second tubular body.

2. The tensioning pole of claim 1, wherein the lever is pivotably mounted to the second surface contact base.

3. The tensioning pole of claim 2, wherein the locking pawl is affixed in the second tubular body proximate the telescoping end.

4. The tensioning pole of claim 1, wherein an outer surface of the lever forms a portion of an outer surface of the second surface contact base.

5. The tensioning pole of claim 1, further comprising at least one shelf unit attached to at least one of either the first tubular body and the second tubular body.

6. The tensioning pole of claim 5, wherein each of the at least one shelf units is adjustably attached to at least one of the tubular bodies.

7. The tensioning pole of claim 1, wherein the second surface contact base comprises the lever.

8. The tensioning pole of claim 7, wherein an entire outer surface of the lever is substantially flush with an outer surface of the second surface contact base when in the first position.

9. The tensioning pole of claim 1, wherein the toothed rack comprises two columns of teeth.

10. The tensioning pole of claim 9, wherein the locking pawl comprises two protrusions each of which corresponds to one of the two columns of teeth on the toothed rack.

* * * * *